United States Patent [19]

Kenny et al.

[11] Patent Number: 4,533,053

[45] Date of Patent: Aug. 6, 1985

[54] ROTARY DRUM MAGNETIC SEPARATOR

[75] Inventors: Garry R. Kenny, College Grove; Edward J. Sommer, Jr.; Charles E. Roos, both of Nashville, all of Tenn.

[73] Assignee: Magnetic Separation Systems, Inc., Nashville, Tenn.

[21] Appl. No.: 498,129

[22] Filed: May 25, 1983

Related U.S. Application Data

[63] Continuation-in-part of Ser. No. 457,675, Jan. 13, 1983.

[51] Int. Cl.[3] ..... B03C 1/02

[52] U.S. Cl. ..... 209/636; 209/221; 209/629; 366/228

[58] Field of Search ..... 209/44.3, 636, 689, 209/690, 930, 629, 684, 687, 213–215, 217, 221, 225, 478; 366/220, 221, 228, 229, 187; 198/493

[56] References Cited

U.S. PATENT DOCUMENTS

| | | | |
|---|---|---|---|
| 2,287,804 | 6/1942 | Johnson | 209/221 |
| 3,087,616 | 4/1963 | Pierson | 209/221 |
| 3,138,408 | 6/1964 | Bruce et al. | 198/493 |
| 3,197,028 | 7/1965 | Watson et al. | 209/221 |
| 3,595,391 | 7/1971 | Schmid | 209/225 |
| 4,046,679 | 9/1977 | Schloemann | 209/221 |
| 4,194,968 | 3/1980 | Pfalzer et al. | 209/224 |
| 4,230,560 | 10/1980 | Nakajima | 209/221 |
| 4,318,804 | 3/1982 | Nakajima | 209/221 |

*Primary Examiner*—Robert B. Reeves
*Assistant Examiner*—Donald T. Hajec
*Attorney, Agent, or Firm*—Abe Hatcher

[57] ABSTRACT

Solid waste incinerator fuel is preclassified by passing it through a hollow rotating cylindrical drum which has magnetic extensions called flights protruding from the inside of the drum wall along its length. The drum may also have a first set of non-magnetic flights toward one end protruding farther from the wall toward the center or axis of the drum then a second non-magnetic portion on the other side of the magnetic flights along the length of the drum. The magnetic flights attract particles and material subject to magnetic attraction. The ends of the first set of non-magnetic flights toward the middle of the length of the drum are preferably shaped or rounded somewhat lengthwise. A scraper assembly preferably having two material removal channels or chutes in addition to a scraper blade, may be arranged to extend into an exit end of the drum. The scraper blade removes magnetic or iron particles from the magnetic flights as the drum rotates. These are carried out of the drum via a first of the two channels, with the non-magnetic noncombustibles being carried out via a second.

15 Claims, 13 Drawing Figures

CHARGING END

DISCHARGE END

ROTARY DRUM MAGNETIC SEPARATOR

This is a continuation-in-part of Ser. No. 457,675, filed Jan. 13, 1983.

BACKGROUND OF THE INVENTION

1. Field of the Invention

This invention relates to separation into fractions of municipal waste or the like. More particularly, it relates to a rotary drum magnetic separator and use thereof.

2. Description of the Prior Art

In our earlier patent application Ser. No. 457,675, we disclosed a rotary fuel homogenizer and how it may be used in separating municipal waste into fractions. Heretofore such municipal waste has had to be shredded before separating into fractions.

SUMMARY OF THE INVENTION

After extended investigation we have found that by use of magnetic flights in a rotary fuel homogenizer we not only obtain better separation into fractions but also eliminate the necessity of shredding of the waste before the separation step. As described in our earlier application, spaced extensions toward the central axis of the drum or cylinder from the inside of the wall going generally lengthwise along its length are called flights. Our magnetic flights may be placed anywhere along the length of the drum except near the end at which the refuse enters. They may be used by themselves or in conjunction with flights such as those of said earlier pending application Ser. No. 457,675. According to one embodiment of our invention the magnetic flights may be placed along the length of the drum between a first plurality of flights which we call large flights due to their extending farther toward the axis than our magnetic flights and a second plurality of flights which we call small flights. Other arrangements include use of only large flights or only small flights in conjunction with our magnetic flights. When large flights are used, they should come before the magnetic flight along the length of the drum from entrance toward exit end. We prefer to curve the large flights toward their downstream or central end longitudinally. In using the drum, we provide a scraper assembly which has a blade at its scraping end to scrape magnetic particles attracted by the magnetic flights off into an exit channel or chute thereof and a separate channel or chute for collecting and moving out the remaining non-magnetic noncombustibles. According to another embodiment of our invention, when small flights are used to aid in the collection and discharge of the non-magnetic noncombustibles, they may be provided with ramps. Other embodiments and features of our invention will be apparent from the description of the drawing and detailed description of the invention which follows.

BRIEF DESCRIPTION OF THE DRAWING

For a better understanding of our invention and of its use, reference will now be made to the drawing, which represents a preferred embodiment of the invention.

In the drawing.

DETAILED DESCRIPTION OF THE INVENTION

Figure 5:
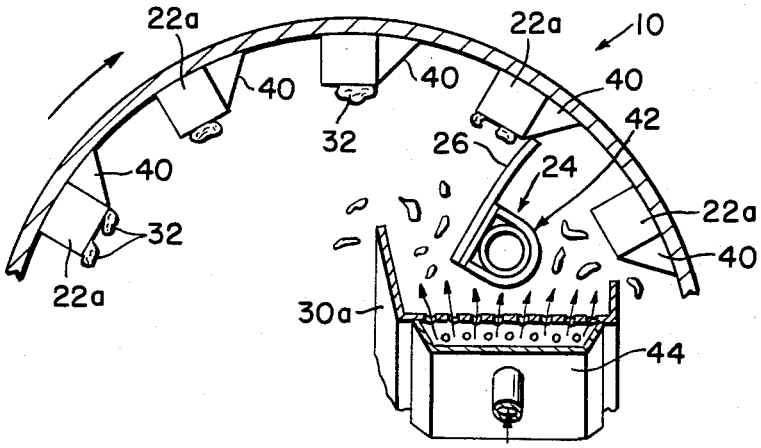
FIG. 5 is similar to the view of FIG. 4 except for showing an additional embodiment of the invention in which an air chute is employed.

In the drawing, the rotary drum magnetic separator 10, 10A, 10B turned by drum drive means 11 includes large flights 20 and small flights 36 in addition to magnetic flights 22, *22a*, *22b*, *22c* and *22d*. When in use a scraper assembly projects into the exit end of the separator 10, the scraper assembly being generally designated by the numeral 24 and comprising principally a scraper support which may include an air tube 28 for an air flow of, for example, 1500 acfm at 60 feet per second directed toward a scraper blade 26 to remove any non-magnetic material, usually mostly light paper, which may be trapped between magnetic metal and magnetic flights 22, and a scraper blade 26, preferably resilient, used to scrape magnetic material attracted by magnetic flights 22 off into associated iron or magnetic waste chute 30, 30, the non-magnetic, noncombustible material being removed via chute 34 with the aid of small flights 36, which may have ramps 38, as may magnetic flights 22 at 40 (FIG. 5).

Leaving a space between magnetic flights 22 and small flights 36, when they are used reduces interaction of the two. Large flights 20 may be shaped or rounded toward their ends toward the midway point along the length of drum 10 to reduce entrainment of objects lifted from the waste by them and possible collision with magnetic flights 22, scraper blade 26 or other parts of the scraper blade assembly 2 or with magnetic or iron waste chute 30. A space left between large flights 20 and magnetic flights 22 also aids in such a reduction of collisions. A ring 18 placed in the input end of our improved rotary fuel homogenizer 10 fits under the lip of a preferred incoming slide 16 so as to contain waste and to prevent catching of long objects in the waste on the large flights 20. The scraper assembly 24, which remains stationary while drum 10 rotates, should be positioned sufficiently far away from the up rotation side of the rotary drum magnetic separator to obtain good separation from non-magnetic objects. If located very far down on the down rotation side, the magnetic material simply lies on the scraper blade and is pushed by the scraper by the action of magnetic flights.

If during rotation of the drum 10 the magnetic flights 22 move by the scraper about at the rate of one every 0.2 to 1.0 second, the magnetic material tends to bounce several times before falling onto chute 30. In other words, in such case after having been scraped off by one flight it is attracted by another magnetic flight before falling far enough to escape attraction. This aids considerably in removal of contamination by non-magnetic material. To further clean the magnetic material air may be blown through a chute such as 44 of FIG. 5 against the rotational direction of the drum 10. This helps reduce catching non-magnetic material, mostly paper.

Figure 6:
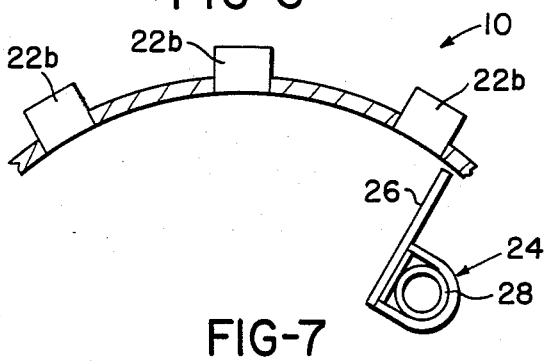
FIG. 6 shows an embodiment in which the magnetic flights are inserted into the wall of the rotary drum magnetic separator.

To reduce damage to the scraper blades 26, as shown in FIG. 6, magnetic flights *22b* may be inset into the wall of the rotary drum 10. Another way of accomplishing the same purpose is to provide ramps from the wall to the top of the flights. This also helps prevent entrapment of odd-shaped pieces.

Figure 8:
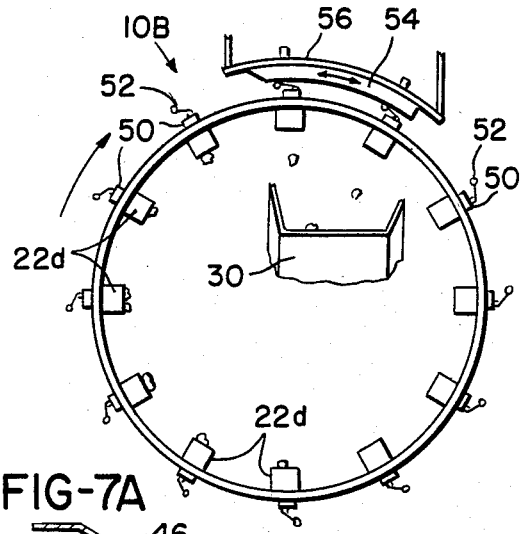
FIG. 8 illustrates schematically another way in which the magnetic flights of the invention may be electromagnetized and switched on and off by a limit switch system.
Figure 7:
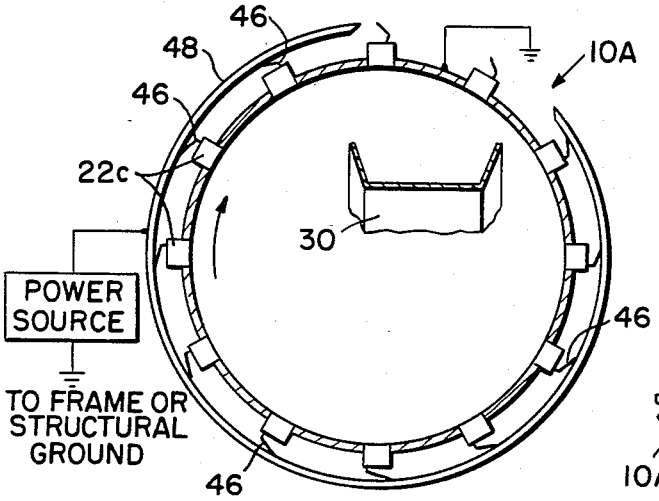
FIG. 7 is a semischematic cross-sectional view looking into the drum from an end and showing an embodiment of the invention whereby the magnetic flights may be electromagnetic and switched on and off by usng brushes to make electrical periodic contact.

No scraper is required according to an embodiment of our invention in which magnetic flights *22c, 22d* are made electromagnetic (either flush or protruding into the drum) and turned on, for example at the 5 o'clock rotational position and off at the 12 to 2 o'clock position. When the electromagnetic setup of FIG. 7 or 8 is employed it is preferred to leave the front edges of the magnetic flights *22c, 22d* flat and without ramps to aid in catching of the magnetic material by bringing it up to flight speed and then catching the magnetic material as it rolls off of the front edges.

Figure 10:
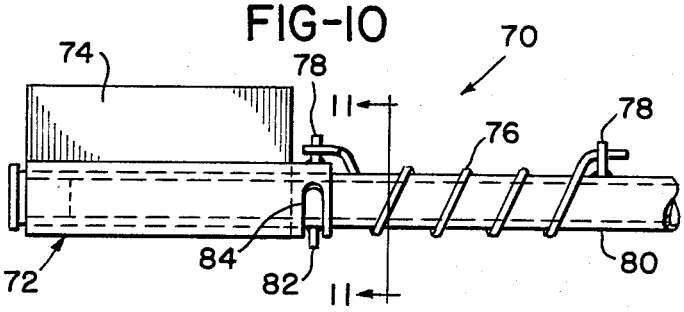
FIG. 10 is a longitudinal side view of a scraper assembly according to one embodiment of the invention.
Figure 11:
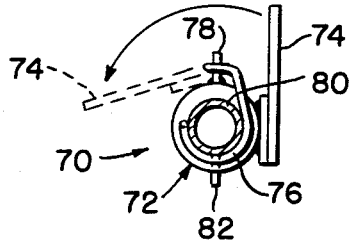
FIG. 11 is an end view of the scraper assembly of FIG. 10 at 11—11 of 10.

The scaper blade 26 should be wide enough for large objects to get by it if not scraped off. We have found a 12-inch width for our size drum very efficient. Scraper blade 26 should also be free to rotate about its support 28. This may be understood better by reference to FIG. 10 showing resilient blade 74 mounted on tube support arm 80 of scraper assembly 70. The details of the scraper blade or scaper assembly 70 include the blade assembly 72, return spring 76, spring retaining and biasing pins 78, blade stop pin 82 and limit slot 84 in blade assembly 72, most of which parts or details may also be seen in FIG. 11, taken at 11—11 of FIG. 10. The stop pin 82, limit slot 84 and return spring 76 enable the blade 74 to move from operating to non-operating position.

Figure 1:
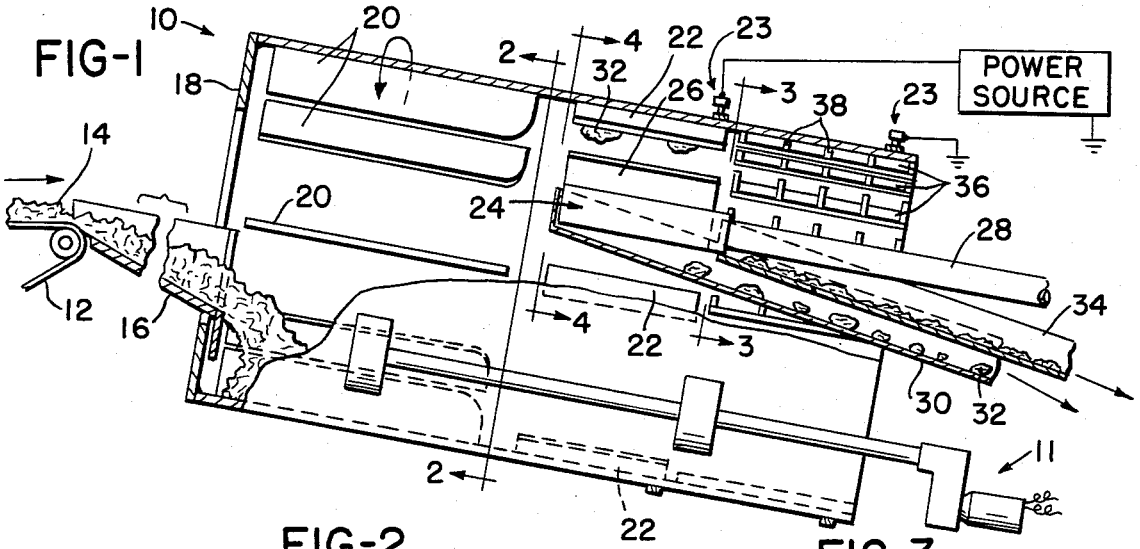
FIG. 1 is a semi-schematic drawing of the rotary drum magnetic separator of the invention looking at it from the side and sufficiently broken away to show how the municipal waste is introduced thereto and the magnetic portion removed therefrom separately from the non-magnetic combustible and noncombustible portion by use of our magnetic flights.
Figure 2:
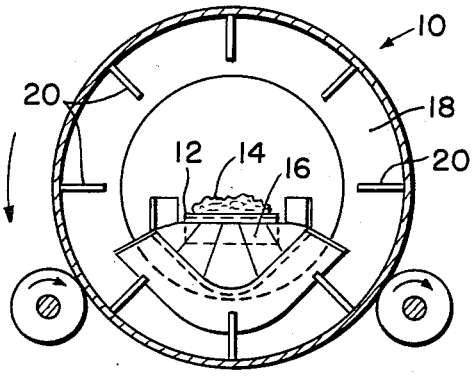
FIG. 2 is a view looking into the charging end of the separator, taken at 2—2 of FIG. 1.
Figure 3:
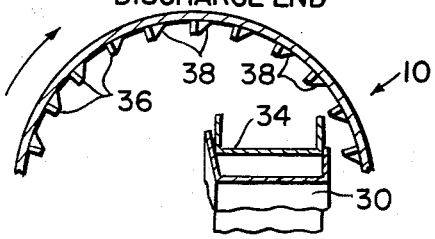
FIG. 3 is a view looking into the rotary drum magnetic separator of the invention from a portion of the discharge end, taken at 3—3 of FIG. 1.
Figure 4:
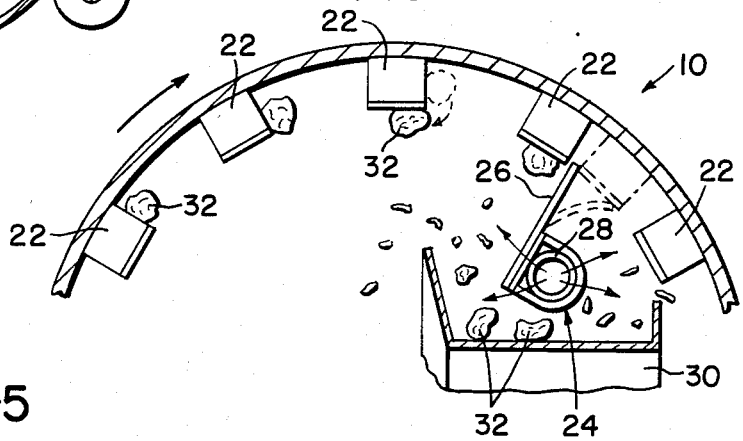
FIG. 4 is a cross-sectional or view from one end of the magnetic flight portion or central portion of the rotary drum magnetic separator, taken at 4—4 of FIG. 1.

When small flights such as 36 are used, then to prevent them from entraining or catching long round or flat objects such as pipes, cardboard and boards and lifting them up into our removal means, we have found it advisable to use short ramps, for example, 1 to 4 inches long on the rotation sides of the flights spaced, for example, 6 to 12 inches apart, as shown at 38 in FIGS. 1 and 3.

Figure 9:
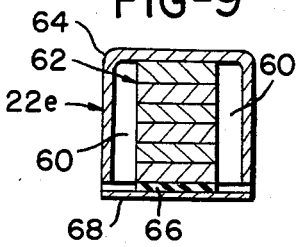
FIG. 9 depicts a permanent magnet flight.

When a permanent magnet is used for the magnetic flights *22e* such as shown in FIG. 9, it may include as parts thereof an air gap 60, magnetic material 62, steel housing 64, a shock absorber 66 such as thin rubber, lead or the like and a non-magnetic cover 68. For remagnetizing a permanent magnet-type flight such as *22a* of FIG. 5 or *22e* of FIG. 9, a magnetizing unit such as 42 may be employed.

Figure 7A:
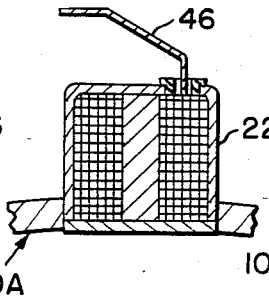
FIG. 7A is an end, partly cross-sectional view showing an electromagnetic flight such as one of the plurality shown in FIG. 7.
Figure 8A:
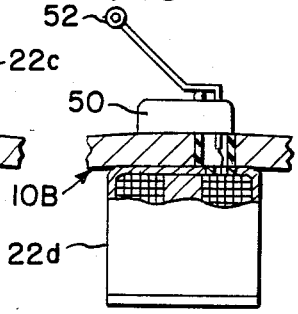
FIG. 8A is more detailed view of the limit switch contact arm arrangement of electromagnetizing the flights as in FIG. 8.

Switches and units for turning electromagnetic flights *22c* and *22d* on and off are shown in FIGS. 7 and 8. The parts used in these systems include a contactor slide blade 46 on flights *22c*, also shown in FIG. 7A, contactor ring 48, limit switch 50, normally closed, also shown in FIG. 8A, limit switch contact arm 52, also shown in FIG. 8A, limit switch cam 54 adjustable to vary the off time and limit switch cam support frame 56.

During operation of the rotary drum magnetic separator 10, waste conveyor input 12 introduces municipal waste 14 into separator 10 via input slide 16. When large and small flights are used in addition to the magnetic flights the waste is subject to the action of large flights 20, magnetic flights 22 and to small flights 36. Iron or magnetic particles or material 32 attracted by magnetic flights 22 drop off or are scraped off into exit chute 30 with non-magnetic noncombustibles being carried into chute 34, which, along with magnetic material chute 30, is preferably angled downward from inlet to outlet end thereof, the scraper assembly 24 remaining stationary as the rotary drum magnetic separator 10 rotates on its axis. Collector rings and brush assembly 23 are shown in association with small flights 36 and associated parts at the outlet end of drum 10.

While the invention has been described in terms of preferred embodiments, the claims appended hereto are intended to encompass all embodiments which fall within the spirit of the invention.

Having thus described our invention and certain preferred embodiments thereof, we claim:

1. Material treating apparatus adapted to be rotated around a cylindrical axis comprising a cylinder open at least in part at both ends thereof and having spaced around the inside of the circumferential wall thereof a plurality of elongated magnetic flights extending toward the central axis of said cylinder, each running longitudinally along a substantial part of the length of said cylinder.

2. The apparatus of claim 1 wherein said cylinder has means for rotating it around said cylindrical axis.

3. The apparatus of claim 1 wherein said magnetic flights are of the permanent type.

4. The apparatus of claim 1 wherein said magnetic flights are of the electromagnetic type.

5. The apparatus of claim 1 wherein said magnetic flights are magnetized by a magnetizing unit in association therewith.

6. The apparatus of claim 1 wherein said magnetic flights are charged by a power source-contactor blade assembly in association therewith.

7. The apparatus of claim 1 wherein said magnetic flights are charged by a limit switch-contact arm system in association therewith.

8. The apparatus of claim 1 wherein said magnetic flights are inset in the wall of said cylinder.

9. The apparatus of claim 1 having additionally a scraper blade assembly non-rotatable with said cylinder inserted into an exit end of said cylinder and adapted to scrape particles from said flights.

10. The apparatus of claim 9 wherein said scraper blade assembly comprises a scraper with a blade, a scraper support adapted to serve as an air tube, a first channel for catching magnetic material and a second channel for catching non-magnetic noncombustibles.

11. The apparatus of claim 1 wherein said cylinder has ring placed at one end thereof adapted to be used as the entrance end thereof.

12. The apparatus of claim 1 including means for introducing material to be separated into parts thereinto and means for removing at least two fractions of material therefrom.

13. The apparatus of claim 1 having longitudinal non-magnetic extensions from the inside of the circumferential wall thereof placed along the length of said cylinder so as to be not in conflict with said magnetic flights.

14. The apparatus of claim 1 having a first plurality of longitudinal non-magnetic extensions from the inside of the circumferential wall of the cylinder placed along the length of the cylinder on one side of the magnetic flights when the cylinder is viewed longitudinally and a second plurality of longitudinal non-magnetic extensions similar but smaller in length toward the central axis of said cylinder than said first plurality on the other side of said magnetic flights.

15. The apparatus of claim 1 having a plurality of non-magnetic extensions from the inside of the circumferential wall of the cylinder curved longitudinally at their downstream ends.

* * * * *